US009141073B2

(12) United States Patent
Nishikawa et al.

(10) Patent No.: US 9,141,073 B2
(45) Date of Patent: Sep. 22, 2015

(54) WASTE-DEVELOPER COLLECTING DEVICE AND IMAGE FORMING APPARATUS INCLUDING THE WASTE-DEVELOPER COLLECTING DEVICE

(71) Applicant: FUJI XEROX CO., LTD., Tokyo (JP)

(72) Inventors: Satoru Nishikawa, Kanagawa (JP); Yutaka Nakayama, Kanagawa (JP); Mihoko Tanaka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 72 days.

(21) Appl. No.: 13/971,207

(22) Filed: Aug. 20, 2013

(65) Prior Publication Data

US 2014/0294475 A1 Oct. 2, 2014

(30) Foreign Application Priority Data

Mar. 27, 2013 (JP) ..... 2013-066792

(51) Int. Cl.
*G03G 21/00* (2006.01)
*G03G 21/10* (2006.01)

(52) U.S. Cl.
CPC ..... *G03G 21/105* (2013.01); *G03G 2215/0129* (2013.01)

(58) Field of Classification Search
USPC ..... 399/358, 360
See application file for complete search history.

(56) References Cited

U.S. PATENT DOCUMENTS

2009/0123189 A1 5/2009 Ichiki et al.
2011/0262174 A1* 10/2011 Gumbe ..... 399/92

FOREIGN PATENT DOCUMENTS

JP A-2009-37063 2/2009
JP A-2010-224017 10/2010

* cited by examiner

*Primary Examiner* — Quana M Grainger
(74) *Attorney, Agent, or Firm* — Oliff PLC

(57) ABSTRACT

A waste-developer collecting device includes a developing device that develops a latent image with developer, a storage section that stores the developer transported from the developing device, and a path section extending from the developing device to the storage section, and including a downward path through which the developer in the developing device flows together with air in the developing device, the downward path guiding the flowing developer downward. An opening is provided on an upper side and an upstream side of a lowermost level of the downward path so that a part of the air flowing in the path section is released out through the opening.

13 Claims, 15 Drawing Sheets

WASTE-DEVELOPER COLLECTING DEVICE AND IMAGE FORMING APPARATUS INCLUDING THE WASTE-DEVELOPER COLLECTING DEVICE

CROSS-REFERENCE TO RELATED APPLICATIONS

This application is based on and claims priority under 35 USC 119 from Japanese Patent Application No. 2013-066792 filed Mar. 27, 2013.

BACKGROUND (i) Technical Field

The present invention relates to a waste-developer collecting device and an image forming apparatus including the waste-developer collecting device.

(ii) Related Art

Image forming apparatuses, such as a copying machine, a printer, a facsimile, apparatus, and an image forming apparatus having functions of these apparatuses, include an image forming apparatus that adopts an electrophotographic image forming system.

In an image forming technique using an electrophotographic image forming system, a toner image is formed by supplying toner from a developing device to an electrostatic latent image that is formed by irradiating a surface of a photoconductor drum with laser light, and is transferred onto a recording medium. Then, the transferred toner image is fixed on the recording medium by a fixing device.

When the processing speed of the image forming apparatus increases, the number of rotations of a developing roller in the developing device increases, and this increases the quantity of toner clouds.

SUMMARY

According to an aspect of the invention, there is provided a waste-developer collecting device including a developing device that develops a latent image with developer, a storage section that stores the developer transported from the developing device, and a path section extending from the developing device to the storage section, and including a downward path through which the developer in the developing device flows together with air in the developing device, the downward path guiding the flowing developer downward. An opening is provided on an upper side and an upstream side of a lowermost level of the downward path so that a part of the air flowing in the path section is released out through the opening.

BRIEF DESCRIPTION OF THE DRAWINGS

An exemplary embodiment of the present invention will be described in detail based on the following figures, wherein.

DETAILED DESCRIPTION

Figure 1:
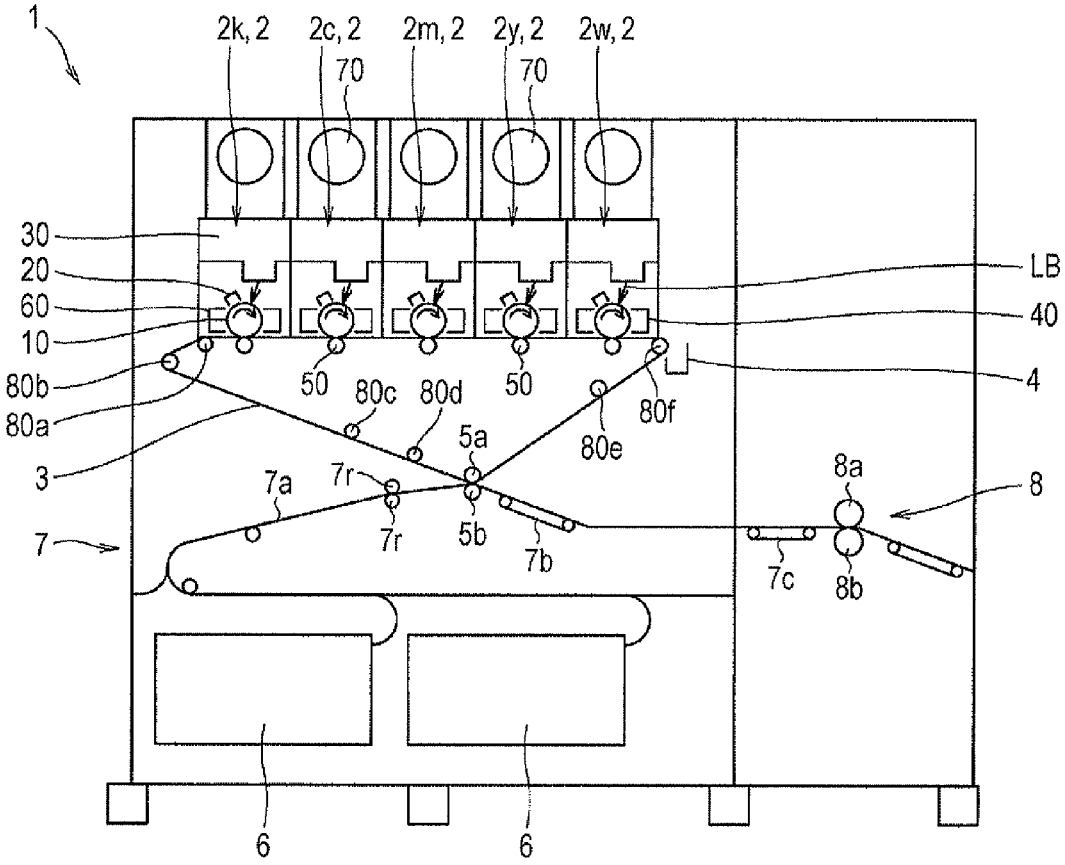
FIG. 1 is a schematic structural front view of an image forming apparatus according to an exemplary embodiment of the present invention.

An exemplary embodiment of the present invention will be described in detail below with reference to the drawings. In the drawings illustrating the exemplary embodiment, identical constituent elements are denoted by the same reference numerals in principle, and repetitive descriptions thereof are skipped.

FIG. 1 is a schematic structural front view of an image forming apparatus according to the exemplary embodiment. While a case using a monocomponent developer composed of toner to be fixed on a recording medium, such as a sheet of paper, will be described here for easy explanation, alternatively, a two-component developer in which carriers are mixed in toner may be used.

An image forming apparatus 1 according to the exemplary embodiment is a tandem color printer as an example, and includes plural image forming units 2 (2*w*, 2*y*, 2*m*, 2*c*, and 2*k*), an intermediate transfer belt (an example of a receiving body) 3, a belt cleaner 4, a backup roller 5*a* and a second transfer roller 5*b* that form a pair, supply containers 6, a transport system 7, and a fixing device 8.

The image forming units 2 include five color image forming units 2*w*, 2*y*, 2*m*, 2*c*, and 2*k* that form toner images, for example, of white, yellow, magenta, cyan, and black, and perform first transfer of images formed according to color image data onto the intermediate transfer belt 3.

These five image forming units 2*w*, 2*y*, 2*m*, 2*c*, and 2*k* are arranged in a rotating direction of the intermediate transfer belt 3, for example, in a color order of white, yellow, magenta, cyan, and black.

Each of the image forming units 2 includes a photoconductor drum (an example of an image carrier) 10, a charging device 20, an exposure device 30, a developing device 40, a first transfer roller (an example of a transfer part) 50, and a drum cleaner 60. The charging device 20 charges a surface of the photoconductor drum 10 to a predetermined potential. The exposure device 30 forms an electrostatic latent image by irradiating the photoconductor drum 10 with laser light LB. The developing device 40 forms a developed toner image by supplying toner onto the surface of the photoconductor drum 10 on which the electrostatic latent image is formed. The first transfer roller 50 transfers the toner image on the surface of the photoconductor drum 10 onto the intermediate transfer belt 3 at a first transfer position. The drum cleaner 60 removes residual toner and paper powder from the surface of the photoconductor drum 10 after the toner image is transferred.

Above each of the image forming units 2, a toner cartridge 70 is provided as an example of a toner supply container that supplies color toner to the corresponding developing device 40. In each of the image forming units 2, the photoconductor drum 10, the charging device 20, the developing device 40, and the drum cleaner 60 are mounted removably from the image forming apparatus 1.

In each of the image forming units 2, the first transfer roller 50 is provided such that the intermediate transfer belt 3 is held between the corresponding photoconductor drum 10 and the first transfer roller 50. By applying a transfer bias voltage having a polarity reverse to a toner charging polarity to the first transfer roller 50, an electric field is produced between the photoconductor drum 10 and the first transfer roller 50, and toner charged on the photoconductor drum 10 is transferred onto the intermediate transfer belt 3 by the Coulomb force. The photoconductor drum 10 rotates clockwise during first transfer.

On the above-described intermediate transfer belt 3, different color toner images formed by the image forming units 2 are sequentially transferred (first transfer) and held. The intermediate transfer belt 3 is wound in an endless form on plural support rollers 80*a*, 80*b*, 80*c*, 80*d*, 80*e*, and 80*f* and the backup roller 5*a*. While the intermediate transfer belt 3 is rotating counterclockwise, the toner images formed by the image forming units 2*w*, 2*y*, 2*m*, 2*c*, and 2*k* are first transferred onto the intermediate transfer belt 3.

The above-described belt cleaner 4 removes and collects toner remaining on the intermediate transfer belt 3 after below-described second transfer performed by the backup roller 5*a* and the second transfer roller 5*b*.

The backup roller 5*a* and the second transfer roller 5*b* described above are paired to constitute a mechanism that collectively transfers (second transfer) multiple toner images transferred on the intermediate transfer belt 3 onto a recording medium, such as a sheet of paper, to form a full-color image. The backup roller 5*a* and the second transfer roller 5*b* are opposed to each other with the intermediate transfer belt 3 being disposed therebetween.

A position where the backup roller 5*a* and the second transfer roller 5*b* are opposed serves as a second transfer position. The backup roller 5*a* is rotatably provided on a back side of the intermediate transfer belt 3, and the second transfer roller 5*b* is rotatably provided at a position opposed to a surface of the intermediate transfer belt 3 on which the toner images are transferred.

The toner images on the intermediate transfer belt 3 are transferred by applying a voltage of the same polarity as the toner charging polarity to the backup roller 5*a* or applying a voltage of a reverse polarity to the toner charging polarity to the second transfer roller 5*b*. Consequently, a transfer electric field is produced between the backup roller 5*a* and the second transfer roller 5*b*, and unfixed toner images held on the intermediate transfer belt 3 are transferred onto a sheet of paper or the like.

Each of the above-described supply containers 6 stores plural sheets. A sheet is drawn out of the supply container 6 by a pick-up roller (not illustrated) in the transport system 7, and is then transported to registration rollers 7*r* through a transport path 7*a* in the transport system 7. The registration rollers 7*r* control the timing at which the transported sheet is transported to the second transfer position.

After the toner images are transferred onto the sheet at the second transfer position, the sheet is transported to the fixing device 8 via transport belts 7*b* and 7*c* in the transport system 7. The fixing device 8 fixes unfixed toner images transferred on the sheet by heat and pressure. The fixing device 8 of the exemplary embodiment includes a heating roller 8*a* and a pressurizing roller 8*b* that are opposed to each other across the transport path. Alternatively, the fixing device 8 may include the heating roller 8*a*, the pressurizing roller 8*b*, and a heating belt (not illustrated) that passes through a fixing nip between the heating roller 8*a* and the pressurizing roller 8*b*.

Figure 2:
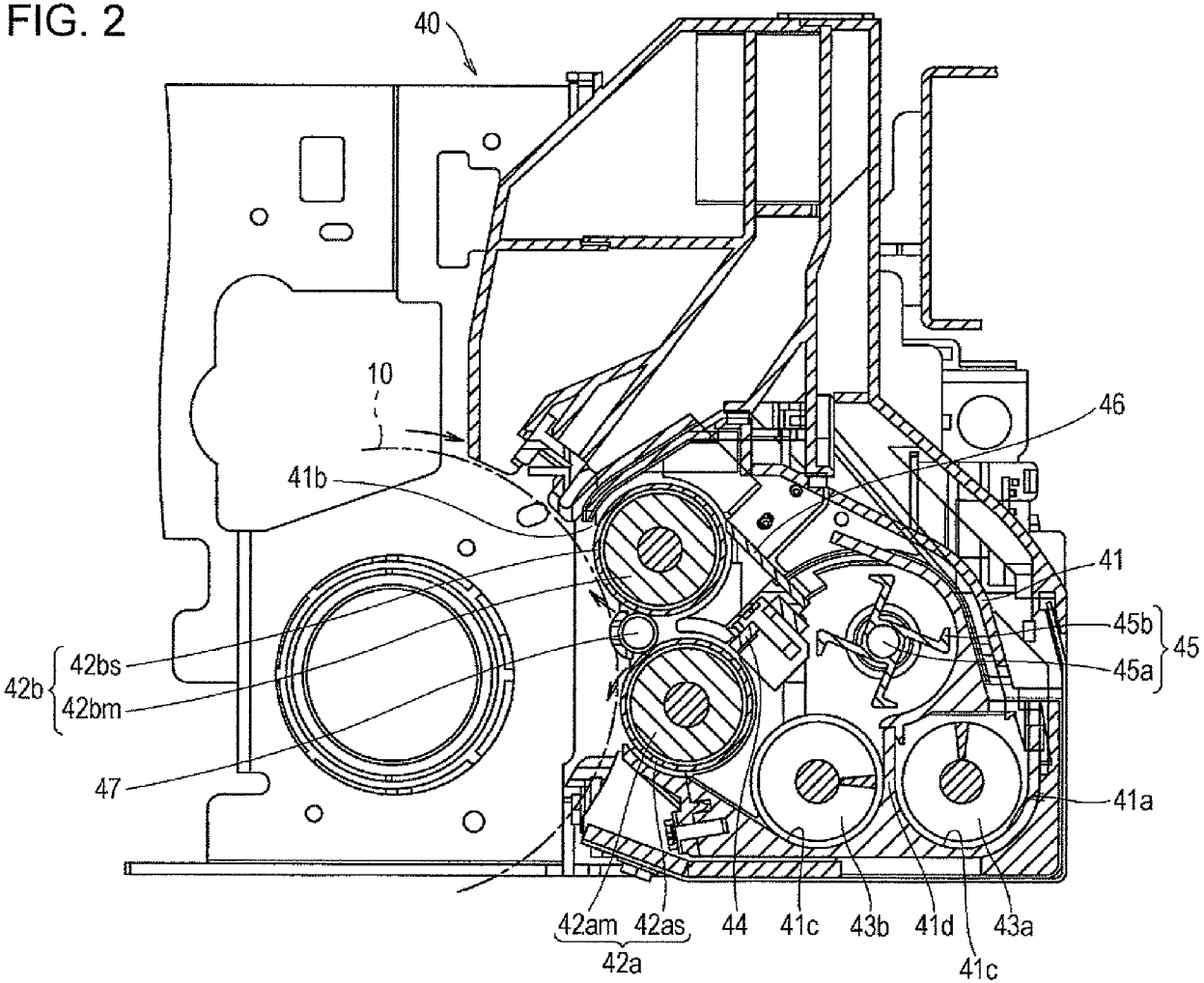
FIG. 2 is a cross-sectional view of a developing device in the image forming apparatus of FIG. 1.

FIG. 2 is a cross-sectional view of each developing device 40 in the image forming apparatus of FIG. 1.

Each developing device 40 includes a housing 41 functioning as a support frame. The housing 41 includes a toner storage section 41*a* that stores toner, and an open portion 41*b* provided at a position opposed to the photoconductor drum 10. In the housing 41, two developing rollers 42*a* and 42*b*, two toner transport members 43*a* and 43*b*, a layer-thickness regulation member 44, a rotating transport body 45, and a toner transport guide 46 are supported.

The developing rollers 42*a* and 42*b* develop a toner image with toner on the surface of the photoconductor drum 10, and are arranged in an up-down direction in a state in which their outer peripheral surfaces are partially exposed from the open portion 41*b*. Rotation shafts of the developing rollers 42*a* and 42*b* are provided along a rotation shaft of the photoconductor drum 10.

The outer peripheral surfaces of the developing rollers 42*a* and 42*b* are opposed to the outer peripheral surface of the photoconductor drum 10 with a gap therebetween, and toner is supplied from the developing rollers 42*a* and 42*b* to the photoconductor drum 10 through the opposed portion (a developing nip, a developing pole). The outer peripheral surfaces of the upper and lower developing rollers 42*a* and 42*b* are opposed to each other with a gap therebetween, and toner is supplied from the lower developing roller 42*a* to the upper developing roller 42*b* through the opposed portion.

The developing rollers 42*a* and 42*b* include magnet rollers 42*am* and 42*bm* and cylindrical sleeves 42*as* and 42*bs* provided on outer peripheries of the magnet rollers 42*am* and 42*bm*, respectively. The magnet rollers 42*am* and 42*bm* are fixed to and supported by the housing 41, and the sleeves 42*as* and 42*bs* are supported rotatably along outer peripheral surfaces of the magnet rollers 42*am* and 42*bm*, respectively.

In the magnet rollers 42*am* and 42*bm*, plural magnetic poles (not illustrated) are magnetized in a circumferential direction. For example, the magnetic poles magnetized in the magnet rollers 42*am* and 42*bm* include an attraction pole for attracting toner, a transport pole for transporting the toner to an adjacent pole, a developing pole for supplying the toner onto the surface of the photoconductor drum 10, and a separating pole for separating the toner. By these magnetic poles, the toner is delivered between the two developing rollers 42*a* and 42*b*, and is supplied to the photoconductor drum 10. The magnetic poles are magnetized in a rotation axis direction of the magnet rollers 42*am* and 42*bm* to form a magnetic field therearound at any position in the rotation axis direction.

The sleeves 42*as* and 42*bs* are formed of a nonmagnetic material such as aluminum, brass, stainless steel, or conductive resin. The sleeve 42*as* in the lower developing roller 42*a* rotates in the same direction as the rotating direction of the photoconductor drum 10 at a portion opposed to the photoconductor drum 10, and the sleeve 42*bs* in the upper developing roller 42*b* rotates in a direction opposite to the rotating direction of the photoconductor drum 10 at a portion opposed to the photoconductor drum 10.

The lower developing roller 42*a* is the last developing roller that supplies toner to the photoconductor drum 10. For this reason, the amount of toner to be supplied to the photoconductor drum 10 is adjusted in the lower developing roller 42*a* so that a good image is formed on the photoconductor drum 10.

At the open portion 41*b* of the housing 41, a sealing roller 47 is provided between the two upper and lower developing rollers 42*a* and 42*b*. The sealing roller 47 seals a space between the developing rollers 42*a* and 42*b* so that the toner in the developing device 40 does not leak outside from between the developing rollers 42*a* and 42*b*. A rotation shaft of the sealing roller 47 is provided along the rotation shafts of the developing rollers 42*a* and 42*b*.

In the above-described toner storage section 41*a*, two toner storage regions 41*c* are arranged along each other with a partition wall 41*d* being disposed therebetween. The two toner storage regions 41*c* are connected via apertures (not illustrated) provided in the partition wall 41*d* at both longitudinal ends of the toner storage section 41*a*.

In the toner storage regions 41*c* of the toner storage section 41*a*, the above-described toner transport members 43*a* and 43*b* are provided rotatably. The toner transport members 43*a* and 43*b* transport toner in the toner storage regions 41*c* in the longitudinal direction of the toner storage section 41*a* while agitating the toner.

For example, spiral rotary blades are provided on outer peripheries of the toner transport members 43*a* and 43*b*. When the toner transport members 43*a* and 43*b* rotate, toner in the toner storage regions 41*c* is transported in opposite directions in the longitudinal direction of the toner storage section 41*a*. The toner in the toner storage regions 41*c* of the toner storage section 41*a* is delivered through the apertures provided in the partition wall 41*d* at both longitudinal ends of the toner storage section 41*a*, and circulates in the toner storage section 41*a*.

The toner transport member 43*b* on a transport downstream side, of the two toner transport members 43*a* and 43*b*, is opposed to the lower developing roller 42*a* with a gap therebetween, and toner is supplied from the toner transport member 43*b* to the lower developing roller 42*a* through the opposed portion.

The toner cartridge 70 (see FIG. 1) is connected to a toner supply port (not illustrated) provided at a longitudinal end of the toner storage section 41*a* via a transport path, and toner (fresh toner) in the toner cartridge 70 is supplied into the toner storage section 41*a* through the toner supply port.

The above-described layer-thickness regulation member 44 is a plate-shaped member that regulates the thickness of a layer of toner transported from the toner transport member 43*b* to the developing rollers 42*a* and 42*b*. Toner delivered from the toner transport member 43*b* on the transport downstream side to the lower developing roller 42*a* is transported to the developing rollers 42*a* and 42*b* after the layer thickness thereof (toner amount) is regulated by the layer-thickness regulation member 44, and is further transported to the portion opposed to the photoconductor drum 10 (developing nip, developing pole).

A distal end of the layer-thickness regulation member 44 is provided opposed to the outer periphery of the lower developing roller 42*a* with a gap corresponding to a predetermined toner layer thickness value therebetween. Toner is frictionally charged by the magnetic interaction between the distal end of the layer-thickness regulation member 44 and the magnet roller 42*am* of the lower developing roller 42*a*, is made into a thin layer, and is held on the surface of the sleeve 42*as* in the lower developing roller 42*a*.

The above-described rotating transport body 45 returns toner remaining on the upper developing roller 42*b* into the toner storage section 41*a*. The rotating transport body 45 is provided directly above a portion between the toner transport members 43*a* and 43*b* and adjacent to the layer-thickness regulation member 44, and is rotatable clockwise. A rotation shaft 45*a* of the rotating transport body 45 is provided along the rotation shafts of the developing rollers 42*a* and 42*b* and the toner transport members 43*a* and 43*b*.

Four rotary blades 45*b* are provided on an outer periphery of the rotation shaft 45*a* of the rotating transport body 45. The rotary blades 45*b* are each bent to have an L-shaped cross section so as to hold transported toner. By rotating the rotating transport body 45 at low speed, toner is accumulated in the rotating transport body 45, so that the storage capacity of toner is increased without increasing the size of the developing device 40.

The above-described toner transport guide 46 forms a path through which the toner remaining on the upper developing roller 42*b* is transported to the rotating transport body 45 and is returned into the toner storage section 41*a*. The toner transport guide 46 is provided between the upper developing roller 42*b* and the rotating transport body 45 and directly above the layer-thickness regulation member 44, and slopes from the upper developing roller 42*b* toward the rotating transport body 45.

The toner transport guide 46 is provided such that its longitudinal direction extends along the developing roller 42*b* and the rotation shaft 45*a* of the rotating transport body 45. After development, the toner remaining on the upper developing roller 42*b* is transferred to the toner transport guide 46 by the repulsion force at the separation pole of the magnet roller 42*bm* and the rotational centrifugal force of the developing roller 42*b*, is transported to the rotating transport body 45 while sliding on a slope surface of the toner transport guide 46.

Figure 3:
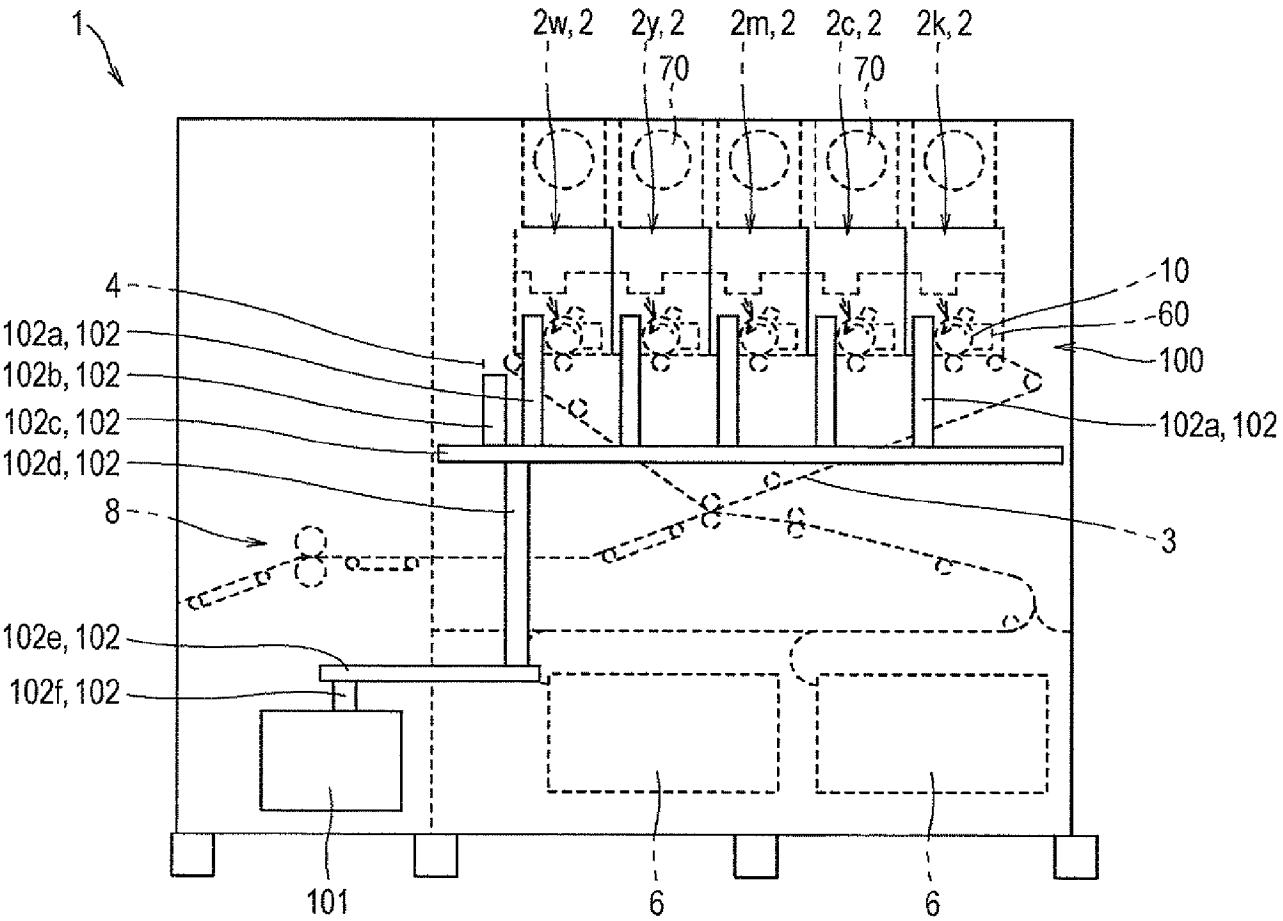
FIG. 3 is a schematic structural rear view of the image forming apparatus of FIG. 1.
Figure 4:
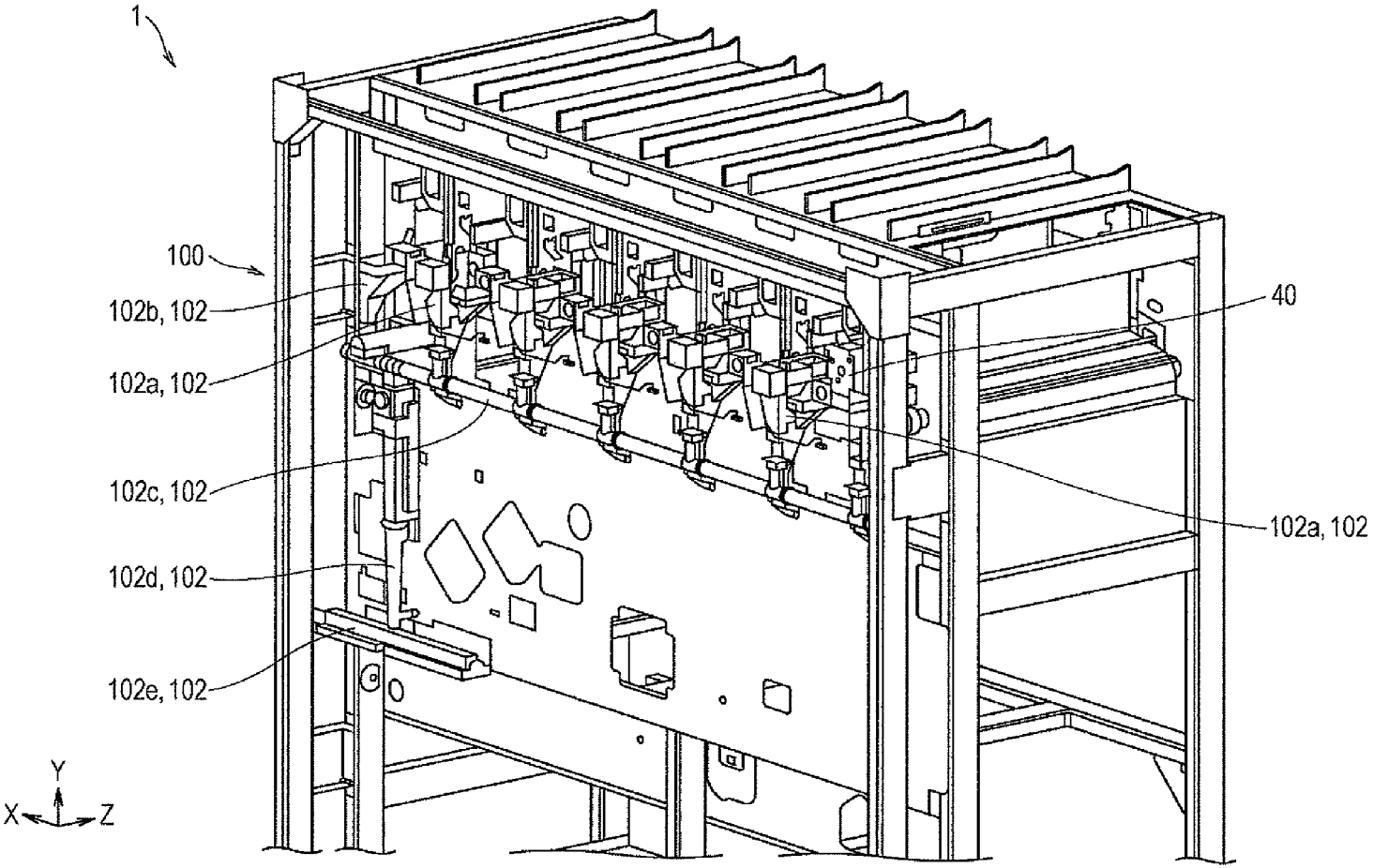
FIG. 4 is an exploded perspective view of the image forming apparatus, illustrating a specific example of an internal rear section of the image forming apparatus of FIG. 3.
Figure 5:
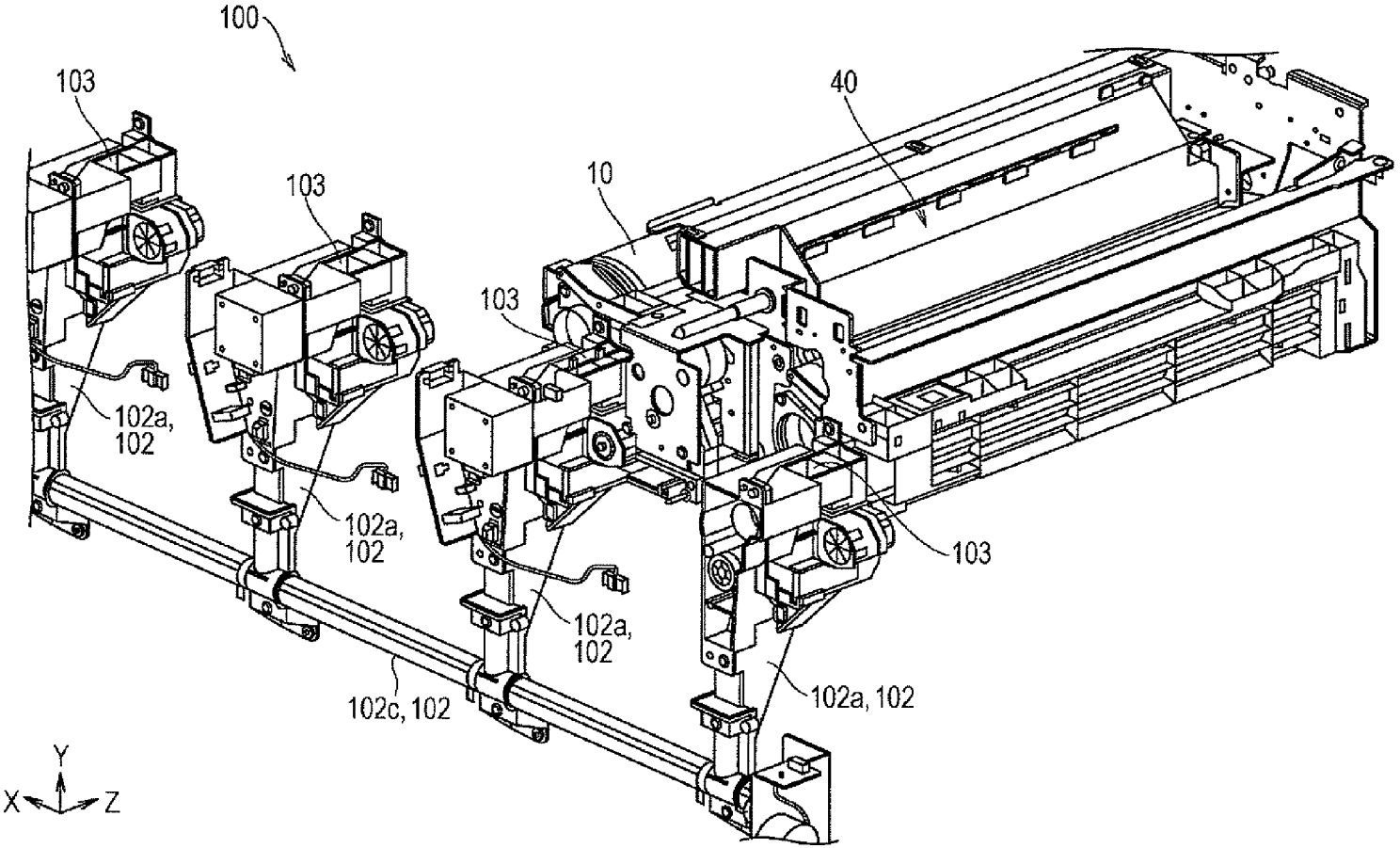
FIG. 5 is an enlarged principal perspective view of a waste-toner collecting device in the image forming apparatus of FIG. 4.

FIG. 3 is a schematic structural rear view of the image forming apparatus of FIG. 1, FIG. 4 is an exploded perspective view of the image forming apparatus, illustrating a specific example of an internal rear section of the image forming apparatus of FIG. 3, and FIG. 5 is an enlarged principal perspective view of a waste-toner collecting device in the image forming apparatus of FIG. 4. In the following drawings, coordinates x, Y, and Z are added for easy understanding of the positional relationship among the drawings.

The image forming apparatus 1 includes a waste-toner collecting device (an example of a waste-developer collecting device) 100 that collects waste toner produced in the image forming apparatus 1.

The waste-toner collecting device 100 includes the plural developing devices 40 provided for the corresponding image forming units 2, a waste-toner collecting container (an example of a storage section) 101 that collects toner, and a transport path section (an example of a path section) 102 connected between the developing devices 40 and the waste-toner collecting container 101 to transport waste toner to the waste-toner collecting container 101.

The transport path section 102 includes funnel units 102*a* and 102*b* and waste-toner collecting pipes 102*c*, 102*d*, 102*e*, and 102*f*.

Plural funnel units 102*a* are arranged in correspondence with the developing devices 40 in the image forming units 2. The funnel units 102*a* are transport pipes having a function of transporting waste toner produced in the developing devices 40 to the waste-toner collecting container 101. The funnel units 102*a* are connected to the corresponding developing devices 40, and extend downward from the height of the developing devices 40 and are connected to the waste-toner collecting pipe 102*c*. As illustrated in FIG. 5, upper surfaces of the funnel units 102*a* have depressurizing openings 103 through which the internal pressure is released from the developing devices 40. As will be described below, the openings 103 communicate with the insides of the funnel units 102*a*. Further, below-described filters (not illustrated) are set at the openings 103 to close the openings 103. The internal structure of the funnel units 102*a* will be described below.

The funnel unit 102*b* is provided in correspondence with the belt cleaner 4. The funnel unit 102*b* is a transport pipe having a function of transporting toner collected by the belt cleaner 4 to the waste-toner collecting container 101. The funnel unit 102*b* is connected to the belt cleaner 4, and extends downward from the height of the belt cleaner 4 to be connected to the waste-toner collecting pipe 102*c*.

The waste-toner collecting pipe 102*c* extends in the direction in which the image forming units 2 are arranged, and is connected to the lower waste-toner collecting pipe 102*e* via the waste-toner collecting pipe 102*d* that is connected to a part of the waste-toner collecting pipe 102*c*. The waste-toner collecting pipe 102*e* extends in the direction in which the image forming units 2 are arranged, and is connected to the lower waste-toner collecting container 101 via the waste-toner collecting pipe 102*f* that is connected to a part of the waste-toner collecting pipe 102*e*.

Figure 6:
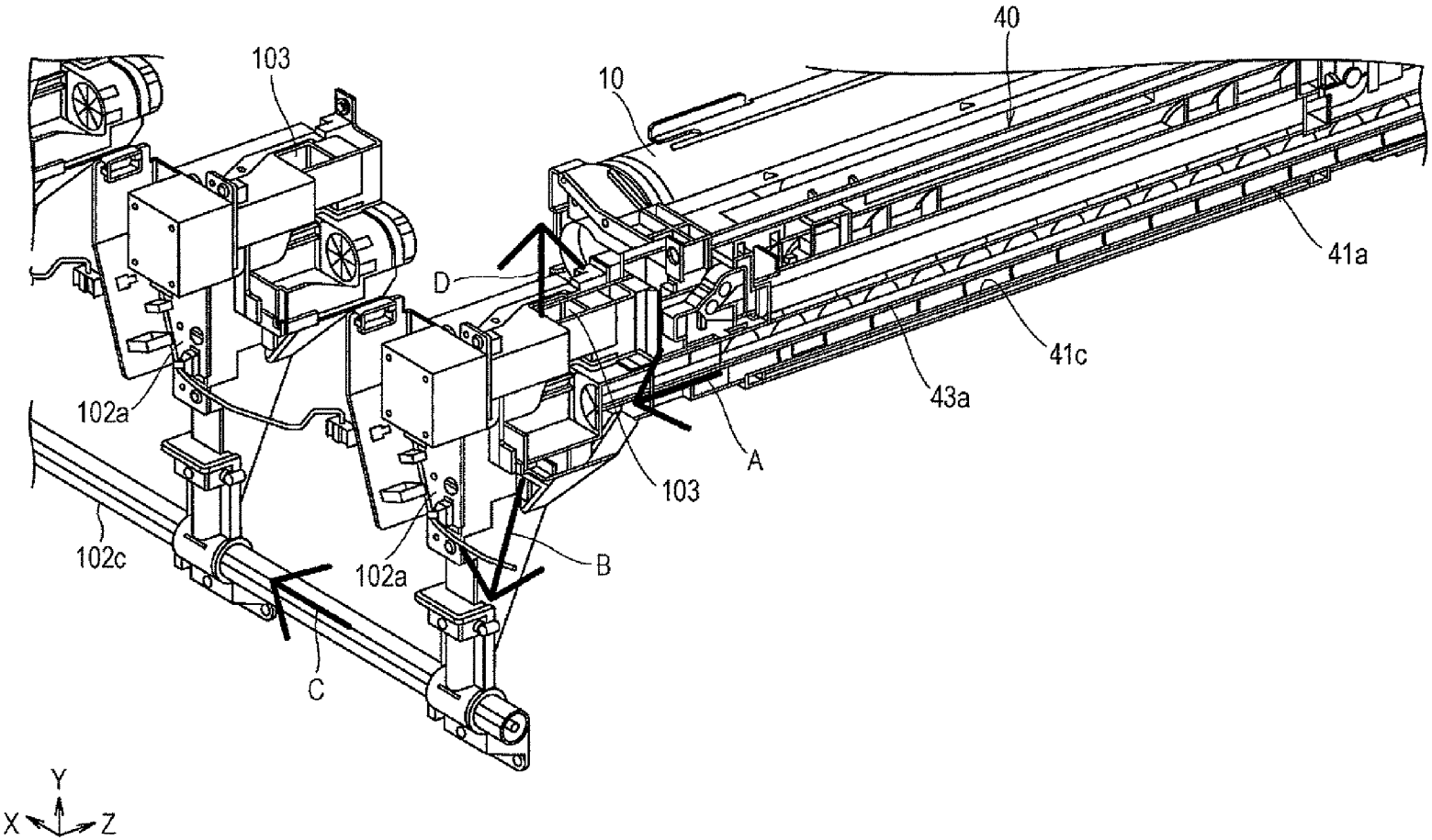
FIG. 6 is a partially cutaway principal perspective view of funnel units and the developing device in the waste-toner collecting device of FIG. 5.
Figure 7:
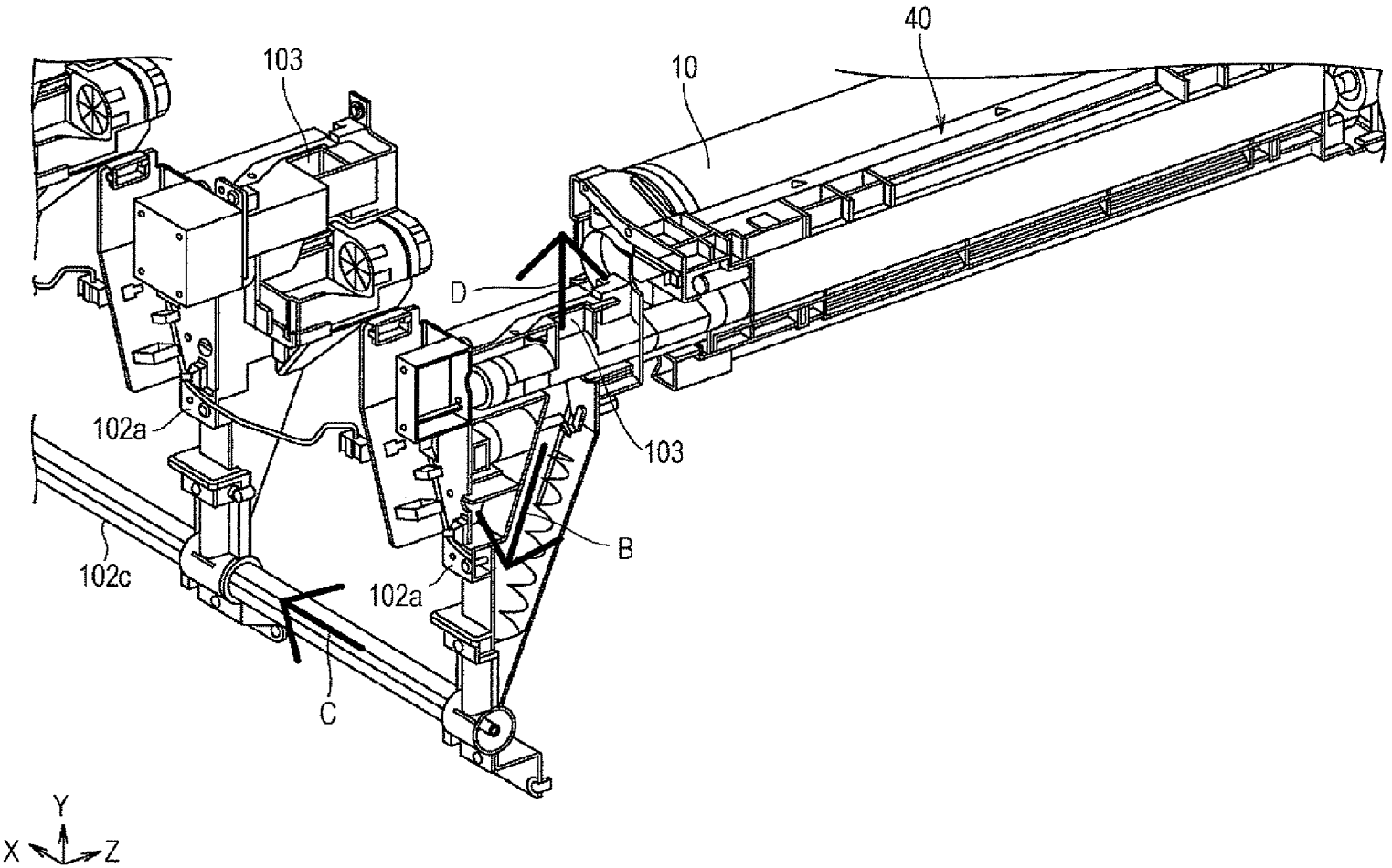
FIG. 7 is a partially cutaway principal perspective view of the funnel units and the developing device in the waste-toner collecting device of FIG. 5.

FIGS. 6 and 7 are partially cutaway principal perspective views of the funnel units and the developing device in the waste-toner collecting device 100 of FIG. 5. Arrow A represents a flow of air (including toner) flowing from the developing device 40 to the funnel unit 102*a*, arrow B represents a flow of waste toner in the funnel unit 102*a*, arrow C represents a flow of waste toner in the waste-toner collecting pipe 102*c*, and arrow D represents a flow of air for releasing the internal pressure of the developing device 40.

As illustrated in FIG. 6, a longitudinal end of one toner storage region 41*c* in the toner storage section 41*a* of the developing device 40 is connected to the funnel unit 102*a*. Since the pressure in the developing device 40 is higher than the pressure outside the image forming apparatus 1, air containing waste toner flows from the inside of the developing device 40 into the funnel unit 102*a*, as shown by arrow A. The toner flowing in the funnel unit 102*a* is transported to the lower waste-toner collecting pipe 102*c* through the path in the funnel unit 102*a*, as shown by arrow B, and is further transported to the waste-toner collecting container 101 (see FIG. 3), as shown by arrow C.

As illustrated in FIG. 7, the space between the photoconductor drum 10 and the developing rollers 42*a* and 42*b* is connected to the funnel unit 102*a*. Since the pressure in the space between the photoconductor drum 10 and the developing rollers 42*a* and the developing roller 42*b* is also higher than the pressure outside the image forming apparatus 1, air containing toner flows from the space into the funnel unit 102*a*. In this case, the toner flowing in the funnel unit 102*a* is also transported to the lower waste-toner collecting pipe 102*c* through the path in the funnel unit 102*a*, as shown by arrow B, and is further transported to the waste-toner collecting container 101.

In contrast, as illustrated in FIGS. 6 and 7, the air (containing toner) flowing from the inside of the developing device 40 and the space between the photoconductor drum 10 and the developing rollers 42*a* and 42*b* into the funnel unit 102*a* is released out of the image forming apparatus 1 from the depressurizing opening 103 provided on the upper surface of the funnel unit 102*a*, as shown by arrow D. A below-described filter (not illustrated in FIGS. 6 and 7) is set at the opening 103.

In this way, in the exemplary embodiment, the funnel unit 102*a* includes both the transport path for the toner from the inside of the developing device 40 and the transport path for the toner from the space between the photoconductor drum 10 and the developing rollers 42*a* and 42*b*.

As described above, the developing rollers 42*a* and 42*b* of the developing device 40 are rotated to supply toner to the photoconductor drum 10 in the image forming apparatus 1. However, when an air current is produced by the rotation of the developing rollers 42*a* and 42*b* and air flows into the developing device 40, toner in the developing device 40, which is unlikely to be electrostatically confined, floats on the air current in the developing device 40, and causes toner clouds. Since the processing speed of the image forming apparatus 1 has recently been increased, the number of rotations of the developing rollers 42*a* and 42*b* of the developing device 40 increases, and this increases the quantity of toner clouds.

In contrast, in the exemplary embodiment, air in the developing device 40 is released through the opening 103 of the funnel unit 102*a* included in the waste-toner collecting device 100, and the internal pressure of the developing device 40 is thereby released. Thus, the pressure difference between the inside and the outside of the developing device 40 is less than in the structure in which the internal pressure is not released. When the pressure difference between the inside and the outside of the developing device is smaller, toner in the developing device is less likely to be released to the outside.

A depressurizing opening is sometimes provided in the housing 41 of the developing device 40. In this case, however, since the opening is close to the toner storage regions 41*c*, the amount of toner that reaches the depressurizing opening increases. If a filter is set at the opening, it is clogged with toner. In contrast, in the exemplary embodiment, the opening 103 for depressurizing the developing device 40 is provided in the funnel unit 102*a* of the waste-toner collecting device 100 remote from the developing device 40. Hence, the amount of toner that reaches the depressurizing opening 103 may be less than when the depressurizing opening is provided in the housing 41 of the developing device 40.

Figure 8:
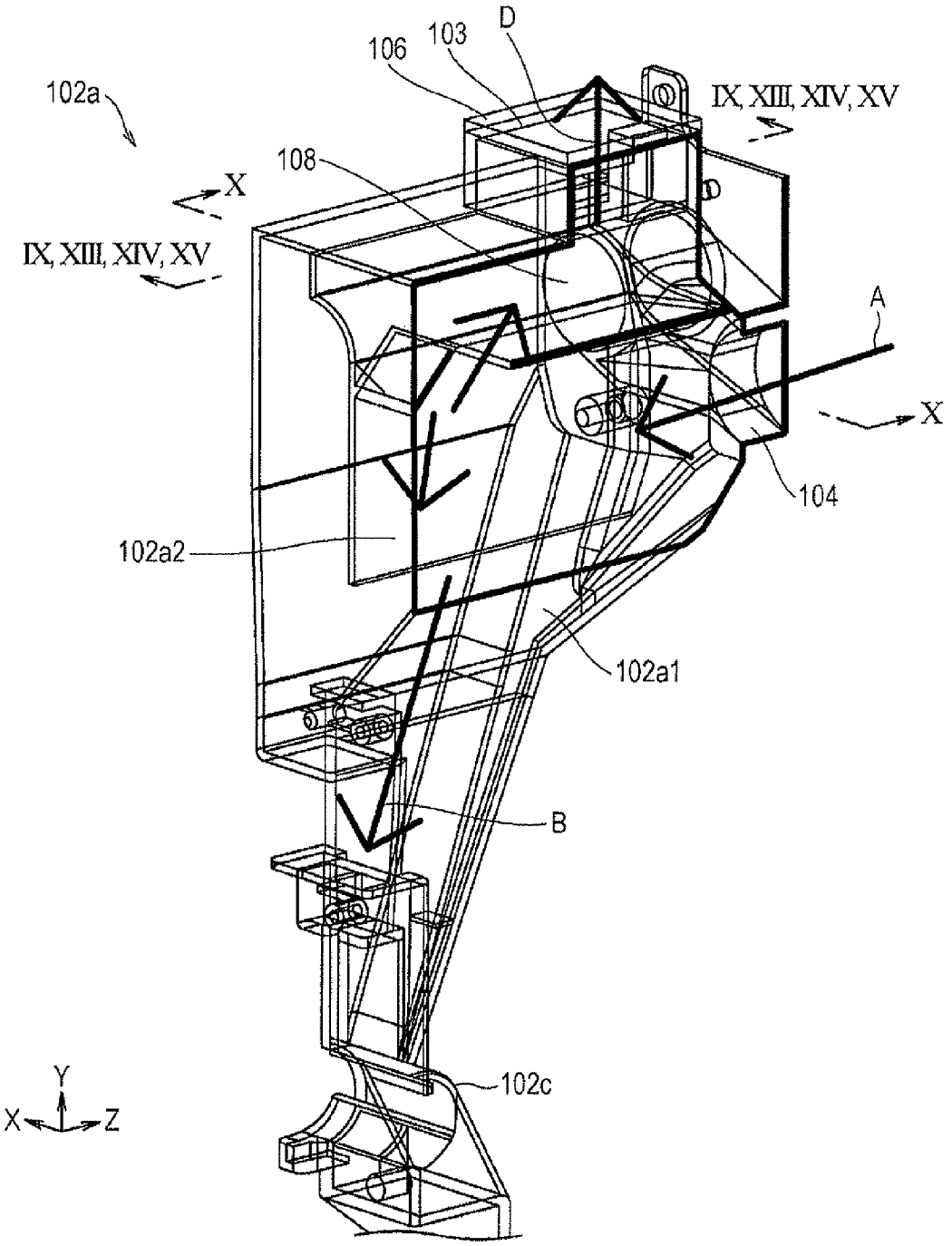
FIG. 8 is a partially cutaway enlarged perspective view of the funnel unit of FIG. 5.
Figure 9:
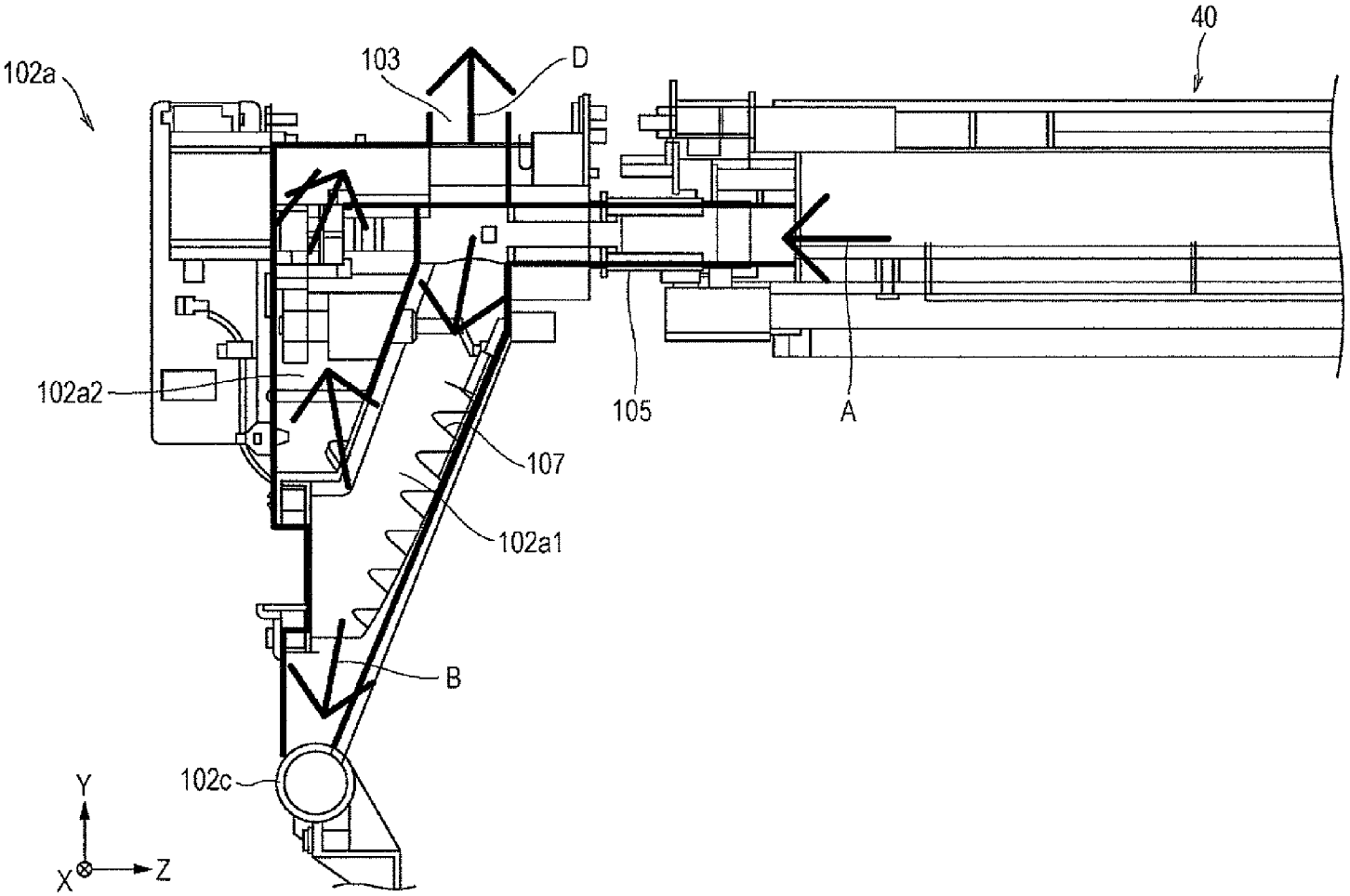
FIG. 9 is a cross-sectional view taken along line IX-IX of FIG. 8.
Figure 10:
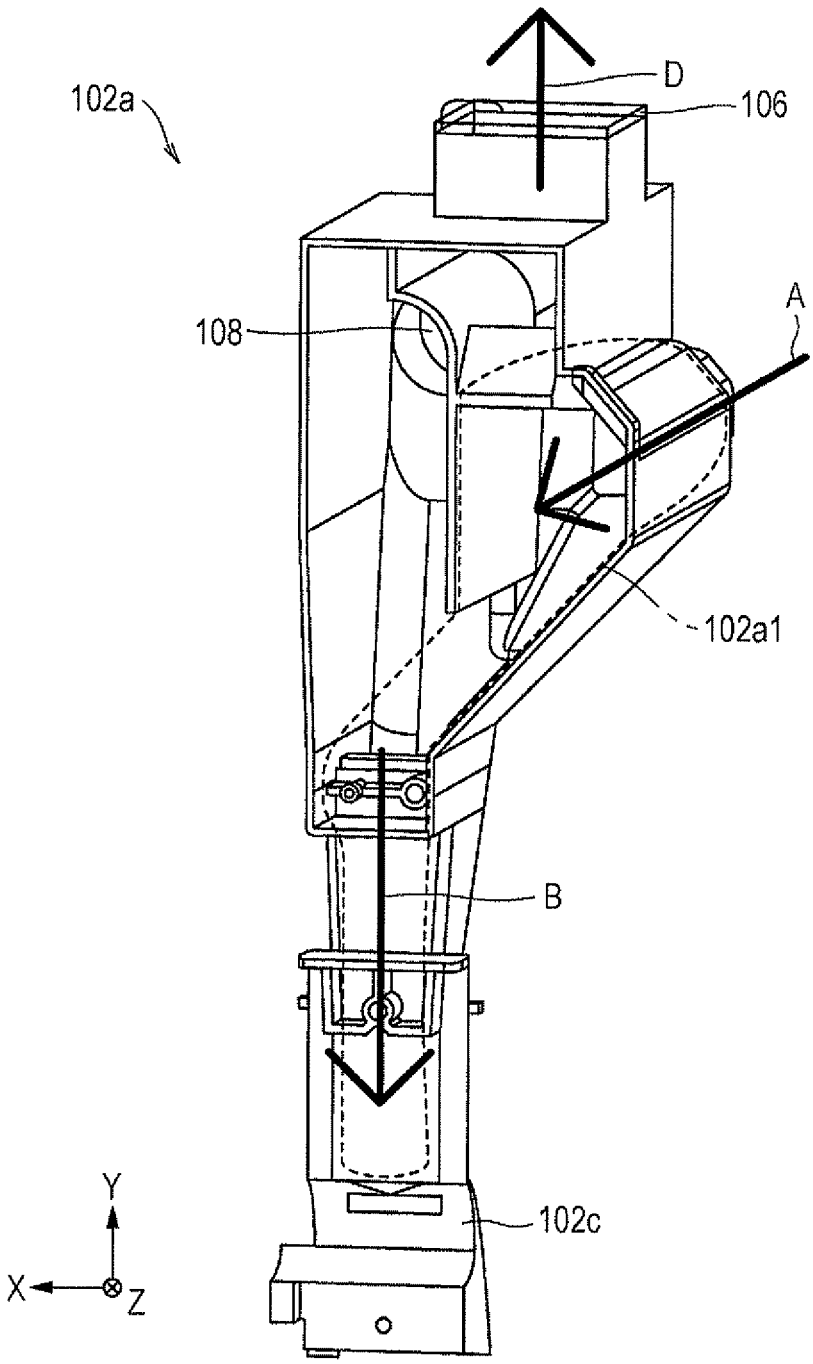
FIG. 10 is a cross-sectional view taken along line X-X of FIG. 8.

FIG. 8 is a partially cutaway enlarged perspective view of the funnel unit 102*a* of FIG. 5, FIG. 9 is a cross-sectional view, taken along line IX-IX of FIG. 8, and FIG. 10 is a cross-sectional view, taken along line X-x of FIG. 8. In FIG. 8, the interior of the funnel unit 102*a* shows through for easy explanation.

The funnel unit 102*a* is hollow. The toner storage region 41*c* of the developing device 40 and the inside of the funnel unit 102*a* are connected to each other via an opening 104 (see FIG. 8) provided in a side face of the funnel unit 102*a*. A seal member 105 (see FIG. 9) is attached to a connecting portion between the developing device 40 and the funnel unit 102*a*. This may ensure higher airtightness than when a seal member is not provided, and may restrict toner from leaking out from the connecting portion between the developing device 40 and the funnel unit 102*a*.

The funnel unit 102*a* includes a first path 102*a*1 extending downward (an example of a downward path) and a second path 102*a*2 branching off a part of the first path 102*a*1 and extending upward (an example of a branch path). The first path 102*a*1 refers to an area having a vertical component, of the transport path section 102, and extends downward from the opening 104 and reaches the waste-toner collecting pipe 102*c*. Also, the first path 102*a*1 guides, to the lower waste-toner collecting pipe 102*c*, toner flowing from the developing device 40 into the funnel unit 102*a* through the opening 104 (see a portion enclosed by a broken line in FIG. 10). Definitions of the downward path and the area having the vertical component illustrated by the first path 102*a*1 will be described below.

In contrast, the second path 102*a*2 extends upward from a middle portion of the first path 102*a*1 and reaches the depressurizing opening 103 provided thereabove. The second path 102*a*2 guides, to the opening 103, air flowing from the developing device 40 into the funnel unit 102*a* through the opening 104.

The opening 103 is provided on an upper side and an upstream side of a lowermost level of the first path 102*a*1 so that a part of air flowing in the transport path section 102 is released out of the transport path section 102. Thus, in the structure for releasing air existing in the developing device 40 to the outside, compared with a case in which the opening 103 through which the air is released is provided in the developing device 40 and a case in which the opening 103 is provided on a downstream side or a lower side of the lowermost level of the first path 102*a*1, the amount of toner that reaches the opening 103 together with the air when the air passes through the opening 103 is reduced. A direction on which the upstream and downstream sides are based is a moving direction of developer in the path that extends from the developing device 40 to the waste-toner collecting container 101 serving as an example of a storage section.

The opening 103 is provided above a branch position where the second path 102*a*2 branches off the first path 102*a*1. Thus, compared with a case in which the opening 103 is not provided above the branch position, when air flowing from the developing device 40 passes through the opening 103, the amount of developer that reaches the opening 103 together with the air is reduced.

The above-described filter 106 (see FIGS. 8 and 10) is attached to the opening 103 to close the opening 103. The filter 106 transmits air flowing in the second path 102*a*2, but rarely transmits toner entering the second path 102*a*2.

The above-described first path 102*a*1 is shaped like a funnel as an example. That is, the first path 102*a*1 has a portion whose cross-sectional area gradually decreases from an upper side toward a lower side. Thus, compared with a case in which the first path 102*a*1 does not have the portion whose cross-sectional area gradually decreases from the upper side toward the lower side, developer floating in the air that flows in the first path 102*a*1 falls more easily. Along the first path 102*a*1, a coil-shaped member 107 (see FIG. 9) is provided. The coil-shaped member 107 promotes falling of toner.

The above-described second path 102*a*2 includes a labyrinth-shaped path. That is, an inner face is provided between the opening 103 and an entrance of the second path 102*a*2 (a portion branching off the first path 102*a*1). The inner face intersects an air flow direction flowing from the entrance of the second path 102*a*2 toward the opening 103. When air flowing in the second path 102*a*2 strikes the inner face, the power of the air declines, and toner floating in the air flowing from the entrance of the second path 102*a*2 toward the opening 103 more easily falls than when the inner face is not provided.

The opening 103 is provided in the upper surface of the funnel unit 102*a*, and is formed as an upward opening. An upward opening refers to an opening such that a vector intersecting a virtual plane defined by a periphery of the opening at a right angle from the inner side of the path has an upward component. By making the opening 103 as an upward opening, compared with a case in which the opening from which air is released from the developing device 40 is not an upward opening, the amount of developer that reaches the opening 103 together with the air when the air passes through the opening 103 is reduced.

The first path 102*a*1 and the second path 102*a*2 are each surrounded by intersecting faces so that the cross-sectional shape taken along a plane intersecting the up-down direction is substantially rectangular. While the cross-sectional shape of the first path 102*a*1 and the second path 102*a*2 may be circular or elliptical, when it is substantially rectangular, air flowing along an inner wall surface of the funnel unit 102*a* and toner in the air easily strike the inner wall surface of the funnel unit 102*a*.

The space between the photoconductor drum 10 and the developing rollers 42*a* and 42*b* is also connected to the first path 102*a*1 and the second path 102*a*2 of the funnel unit 102*a* via an opening 108 (see FIGS. 8 and 10). With this structure, toner, which flows from the space into the funnel unit 102*a* through the opening 108, is transported to the waste-toner collecting pipe 102*c* through the first path 102*a*1 and is further transported to the waste-toner collecting container 101.

In contrast, air flowing in the funnel unit 102*a* through the opening 108 flows to the depressurizing opening 103 through the second path 102*a*2, and is released out of the image forming apparatus 1 via the filter 106.

Figure 11:
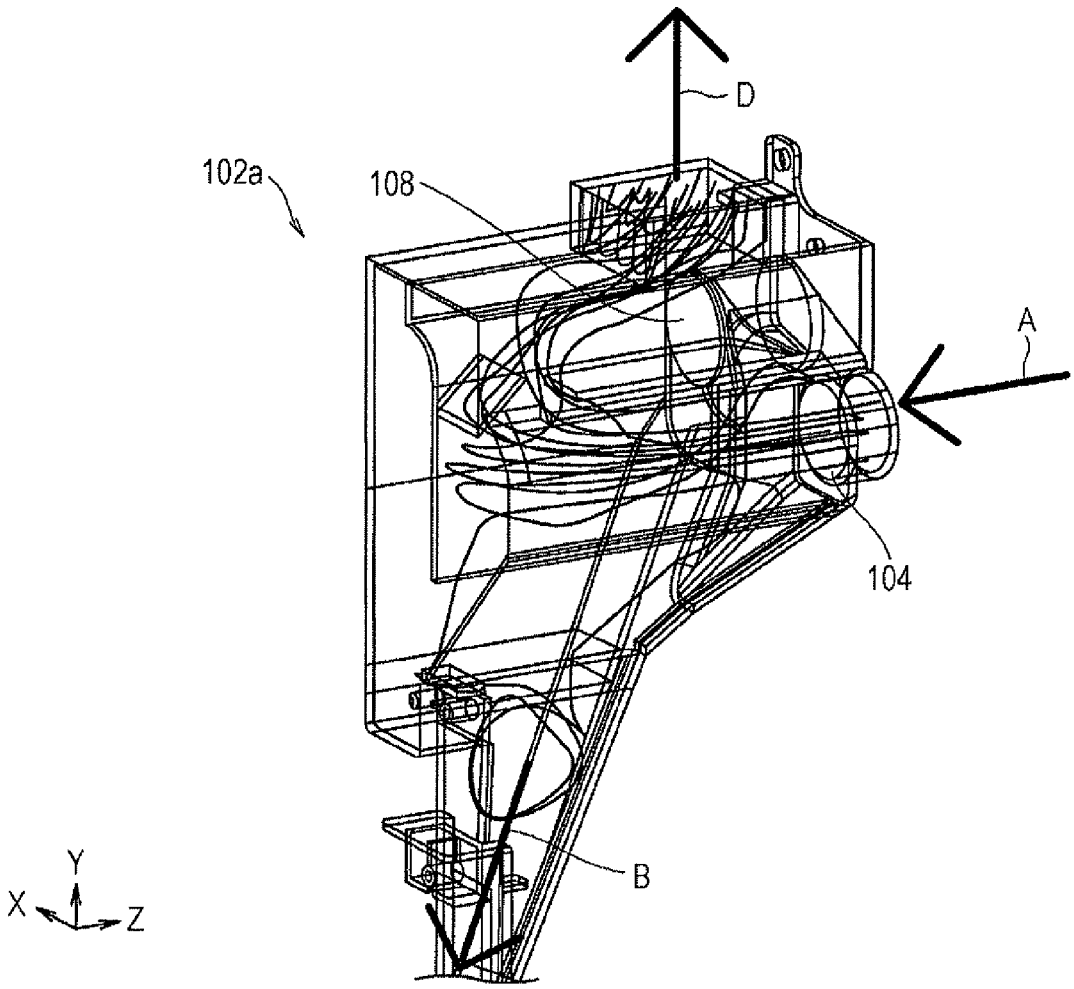
FIG. 11 is a perspective view of the funnel unit, schematically illustrating flows of air and toner flowing from the developing device into the funnel unit of FIG. 8.
Figure 12:
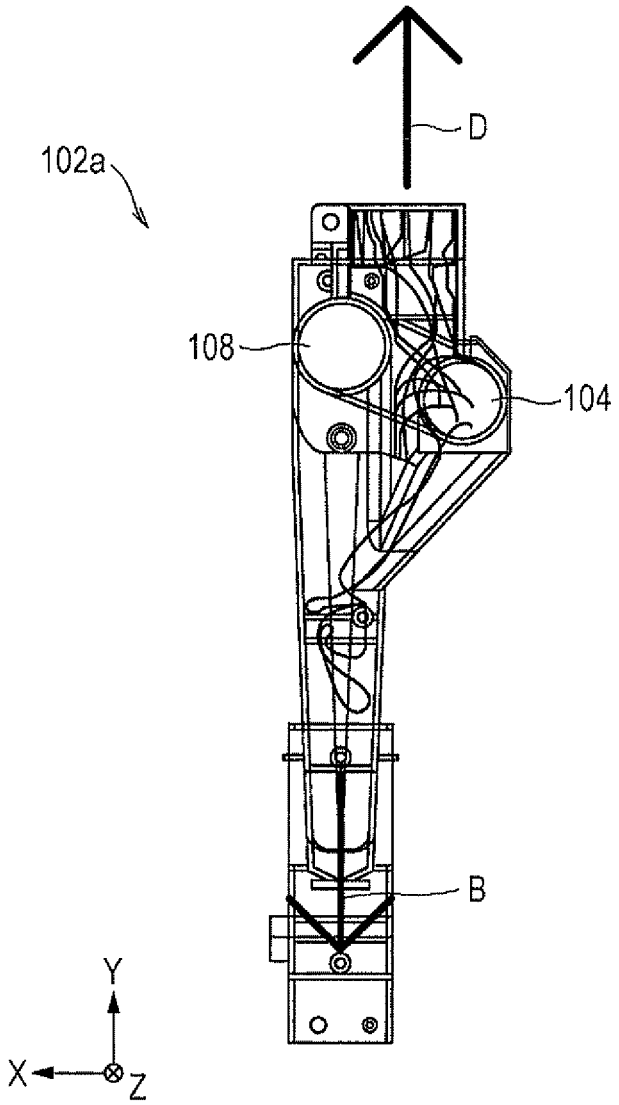
FIG. 12 is a front view of the funnel unit, schematically illustrating flows of air and toner flowing from the developing device into the funnel unit of FIG. 8.

FIG. 11 is a perspective view of the funnel unit of FIG. 8, schematically illustrating flows of air and toner flowing from the developing device into the funnel unit, and FIG. 12 is a front view of the funnel unit of FIG. 8, schematically illustrating the flows of air and toner flowing from the developing device into the funnel unit. In FIGS. 11 and 12, the interior of the funnel unit 102*a* shows through in order to illustrate the flows of air and toner.

Figure 13:
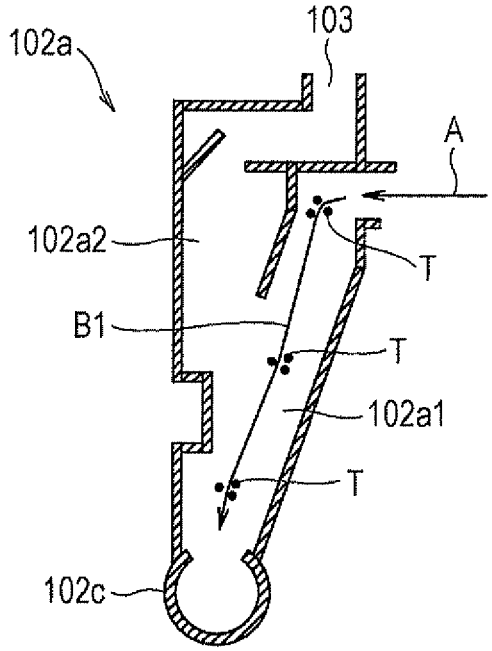
FIG. 13 is a cross-sectional view of the funnel unit, taken along line XIII-XIII of FIG. 8.
Figure 14:
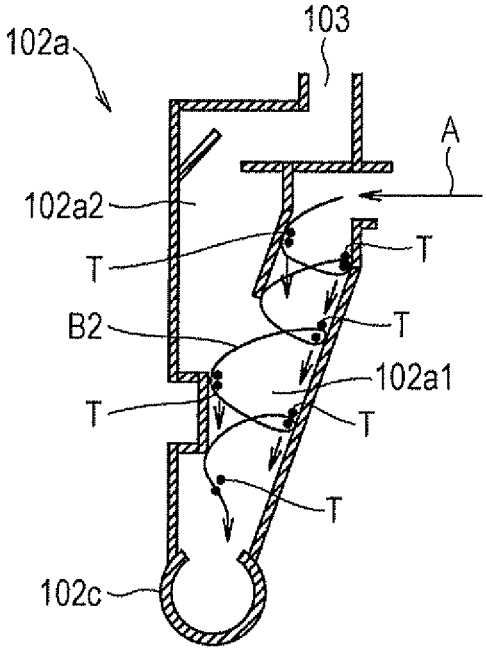
FIG. 14 is a cross-sectional view of the funnel unit, taken along line XIV-XIV of FIG. 8.
Figure 15:
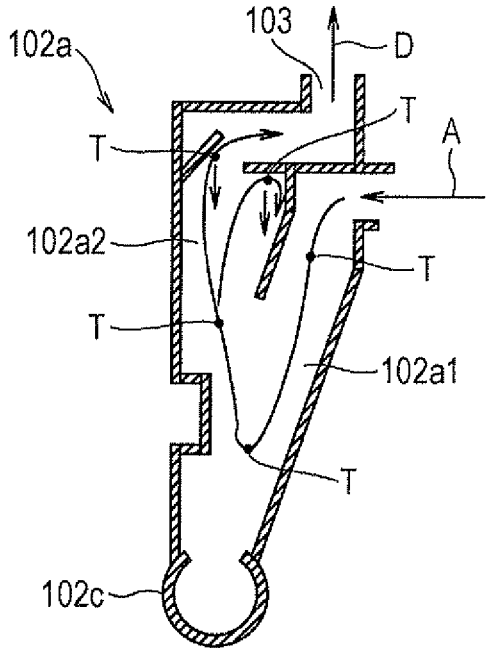
FIG. 15 is a cross-sectional view of the funnel unit, taken along line XV-XV of FIG. 8.

Irregular lines in the funnel unit 102*a* represent flows of air and toner. FIGS. 13, 14, and 15 illustrate examples in which toner falls in the funnel unit 102*a*. FIGS. 13, 14, and 15 are cross-sectional views of the funnel unit 102*a*, taken along lines XIII-XIII, XIV-XIV, and XV-XV of FIG. 8, respectively. In these figures, alphabet T represents toner.

As shown by arrow B1 of FIG. 13, a large part of (more than or equal to half of) toner T flowing into the funnel unit 102*a* together with air falls by gravity.

More than or equal to half of the remaining toner T flowing into the funnel unit 102*a* together with air strikes the inner wall surface of the funnel unit 102*a* on the air current. The toner T striking the inner wall surface loses momentum and falls by gravity. In the exemplary embodiment, when air flows from the developing device 40 into the funnel unit 102*a* via the side face of the funnel unit 102*a*, an air current is formed along the inner wall surface of the funnel unit 102*a*, as shown by arrow B2 of FIG. 14. Then, the toner T heavier than the air is separated toward the outer peripheral side of the air current, and strikes the inner wall surface of the funnel unit 102*a*. The toner T striking the inner wall surface loses momentum, and falls by gravity.

A part having a small particle diameter, of the remaining toner T flowing in the funnel unit 102*a*, sometimes flows into the second path 102*a*2 on the air current in the funnel unit 102*a*, as illustrated in FIG. 15. However, the toner T flowing in the second path 102*a*2 strikes the wall surface of the second path 102*a*2 that forms a labyrinth. The toner T striking the wall surface loses momentum and falls by gravity.

In the exemplary embodiment, the downward path refers to a path into which developer flows together with air in the developing device and which guides the flowing developer downward. The downward path represents an area of the path section having a vertical component.

For example, when a path having no vertical component is provided on the upstream side, the area having the vertical component starts from a lower end (a side of the area having the vertical component) of a connecting portion to the path having no vertical component. For example, when the path having no vertical component is provided on the downstream side, the area having the vertical component ends at an upper end (a side of the area having the vertical component) of the connecting portion to the path having no vertical component. As described above, the direction on which the upstream and downstream sides are based is the moving direction of developer in the path from the developing device 40 toward the waste-toner collecting container 101.

Figure 16:
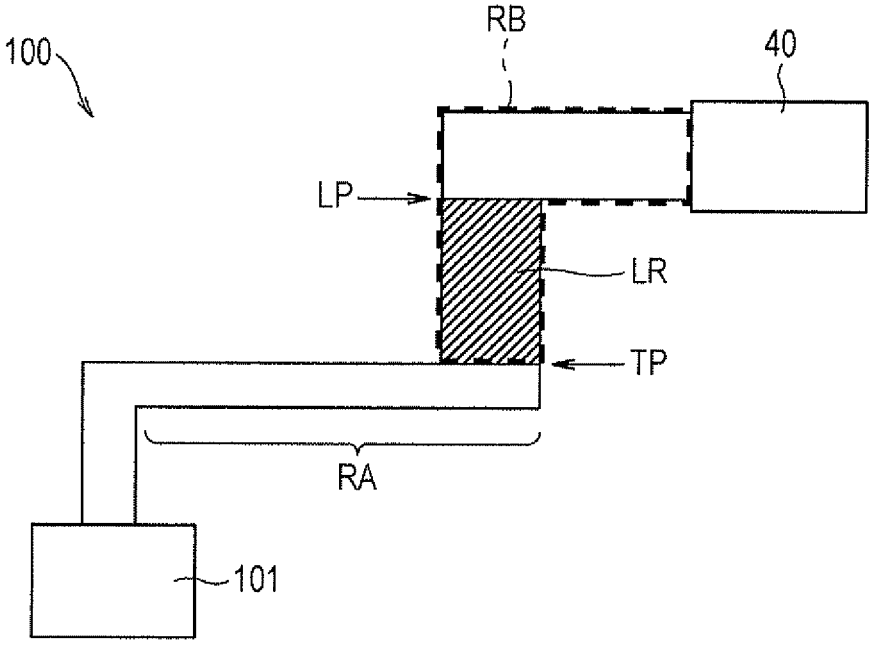
FIG. 16 is a schematic structural view of the waste-toner collecting device, illustrating an example of a downward path.

FIG. 16 is a schematic structural view of the waste-toner collecting device, illustrating an example of a downward path. In the exemplary embodiment, in the path from the developing device 40 to the waste-toner collecting container 101, an area having a vertical component between a lower end LP of a connecting portion to the upstream developing device 40 and an upper end TP of a connecting portion to a downstream path RA having no vertical component is an example of a downward path LR. In FIG. 16, the downward path LR is hatched for easy understanding of the figure. Also, a region enclosed by a broken line of FIG. 16 represents an example of a region RB on an upper side and an upstream side of a lowermost level of the downward path LR.

Figure 17:
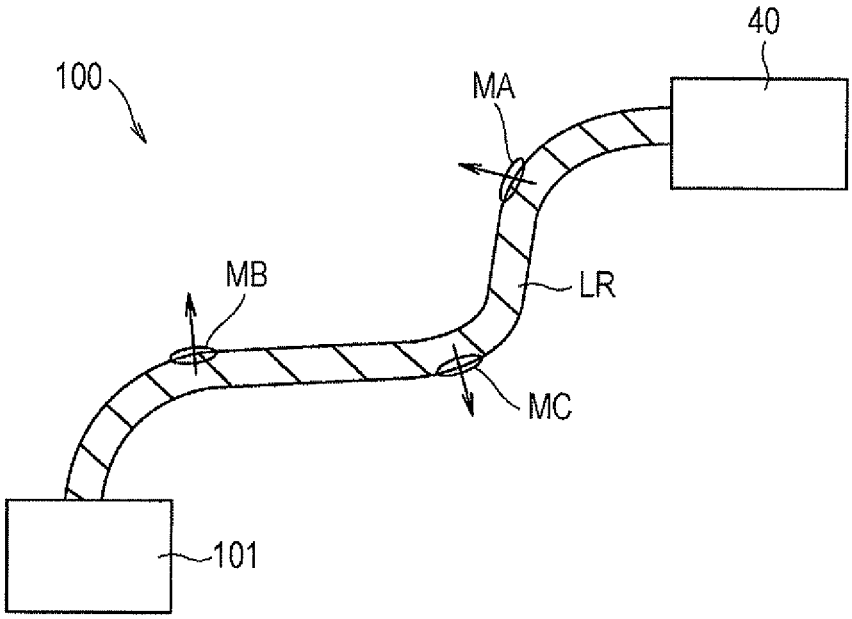
FIG. 17 is a schematic structural view of the waste-toner collecting device, illustrating cases in which upward openings and an opening that is not an upward opening are provided.

In the exemplary embodiment, the upward opening refers to an opening such that a vector perpendicularly intersecting a virtual plane defined by an outer periphery of the opening from the inner side of the path has an upward component. FIG. 17 is a schematic structural view of the waste-toner collecting device, illustrating an example in which upward openings and a different opening are provided. Openings MA and MB of the downward path LR in the path section between the developing device 40 and the waste-toner collecting container 101 are upward openings because vectors shown by arrows have upward components, but an opening MC is not an upward opening because a vector shown by arrow does not have an upward component. For easy understanding of the figure, the downward path LR is hatched.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

For example, in the exemplary embodiment, the present invention is applied to the intermediate transfer image forming apparatus in which an image transferred on the intermediate transfer belt is transferred onto a sheet of paper or the like. Alternatively, the exemplary embodiment may be applied to a direct-transfer image forming apparatus in which a toner image on a photoconductor drum is directly transferred onto a sheet of paper or the like.

While the present invention is applied to the image forming apparatus using color toners in the exemplary embodiment, it is not limited thereto. Alternatively, the present invention may be applied to an image forming apparatus using toner of a single color such as black.

While the developing device includes two developing rollers in the exemplary embodiment, the exemplary embodiment is not limited thereto. Alternatively, a developing device including only one developing roller may be used.

While the present invention is applied to the color printer in the exemplary embodiment, for example, it may be applied to other image forming apparatuses such as a color copying machine, a facsimile apparatus, or an image forming apparatus having both functions of these apparatuses.

What is claimed is:

1. A waste-developer collecting device comprising:

a developing device that develops a latent image with developer;

a storage section that stores the developer transported from the developing device; and a path section extending from the developing device to the storage section, and including a downward path through which the developer in the developing device flows together with air in the developing device, the downward path guiding the flowing developer downward, wherein an opening is provided on an upper side and an upstream side of a lowermost level of the downward path so that a part of the air flowing in the path section is released out through the opening.

2. The waste-developer collecting device according to claim 1, wherein the opening is an upward opening.

3. The waste-developer collecting device according to claim 1, wherein the path section further includes a branch path branching upward on the upper side and the upstream side of the lowermost level of the downward path, and wherein the opening is provided in the branch path and above a branch position where the branch path branches.

4. The waste-developer collecting device according to claim 2, wherein the path section further includes a branch path branching upward on the upper side and the upstream side of the lowermost level of the downward path, and wherein the opening is provided in the branch path and above a branch position where the branch path branches.

5. The waste-developer collecting device according to claim 3, wherein the branch path includes, between the branch position of the branch path and the opening, an inner face that intersects an air flow direction flowing into the branch path at the branch position.

6. The waste-developer collecting device according to claim 4, wherein the branch path includes, between the branch position of the branch path and the opening, an inner face that intersects an air flow direction flowing into the branch path at the branch position.

7. The waste-developer collecting device according to claim 1, wherein the downward path has a portion whose cross-sectional area decreases from an upper side toward a lower side.

8. The waste-developer collecting device according to claim 2, wherein the downward path has a portion whose cross-sectional area decreases from an upper side toward a lower side.

9. The waste-developer collecting device according to claim 3, wherein the downward path has a portion whose cross-sectional area decreases from an upper side toward a lower side.

10. The waste-developer collecting device according to claim 4, wherein the downward path has a portion whose cross-sectional area decreases from an upper side toward a lower side.

11. The waste-developer collecting device according to claim 5, wherein the downward path has a portion whose cross-sectional area decreases from an upper side toward a lower side.

12. The waste-developer collecting device according to claim 6, wherein the downward path has a portion whose cross-sectional area decreases from an upper side toward a lower side.

13. An image forming apparatus comprising:

the waste-developer collecting device according to claim 1;

an image carrier that carries the latent image developed with the developer supplied from the developing device in the waste-developer collecting device; and a transfer part that transfers the latent image on the image carrier onto a receiving body.

* * * * *